US010384458B1

(12) United States Patent
Anderson, Jr. et al.

(10) Patent No.: US 10,384,458 B1
(45) Date of Patent: Aug. 20, 2019

(54) FLUIDIC EJECTION CARTRIDGE FOR IMPROVED PROTECTIVE TAPE REMOVAL

(71) Applicant: FUNAI ELECTRIC CO., LTD., Osaka (JP)

(72) Inventors: James D. Anderson, Jr., Lexington, KY (US); Paul W. Dryer, Lexington, KY (US); Jason Vanderpool, San Jose, CA (US)

(73) Assignee: Funai Electric Co., Ltd. (JP)

( * ) Notice: Subject to any disclaimer, the term of this patent is extended or adjusted under 35 U.S.C. 154(b) by 0 days.

(21) Appl. No.: 15/973,690

(22) Filed: May 8, 2018

(51) Int. Cl.
*B41J 2/175* (2006.01)

(52) U.S. Cl.
CPC ..... *B41J 2/17536* (2013.01); *B41J 2/17553* (2013.01)

(58) Field of Classification Search
CPC ..... B41J 2/17536; B41J 2/17553; B41J 2002/14443
USPC ..... 347/29, 86
See application file for complete search history.

(56) References Cited

U.S. PATENT DOCUMENTS 8,287,108 B2 10/2012 Uehara et al.
2002/0071014 A1 6/2002 Matsumoto et al.
2003/0052939 A1* 3/2003 Farr ..... B41J 2/17536 347/29
2005/0211594 A1* 9/2005 Katsuyama ..... B41J 2/1752 206/461
2006/0221119 A1* 10/2006 Bertelsen ..... B41J 2/17536 347/29
2007/0064059 A1* 3/2007 Inamoto ..... B41J 2/1752 347/64
2007/0263034 A1* 11/2007 Yoshihira ..... B41J 2/17536 347/47
2008/0259119 A1 10/2008 Ikegame et al.
2009/0128602 A1 5/2009 Goto et al.
2010/0295888 A1* 11/2010 Noguchi ..... B41J 2/17536 347/20
2012/0098885 A1* 4/2012 Harada ..... B41J 2/17536 347/29

* cited by examiner

*Primary Examiner* — Huan H Tran
*Assistant Examiner* — Alexander D Shenderov
(74) *Attorney, Agent, or Firm* — Luedeka Neely Group, PC

(57) ABSTRACT

A fluidic ejection cartridge and protective tape system therefor. The fluidic ejection cartridge includes a cartridge body having a cover closing a first end thereof, an ejection head on a second end thereof, and side walls attached to the first and second ends. The side walls include a first side wall, a second side wall, a third side wall attached to the first and second side walls, and a fourth side wall opposite the third side wall. A first removable tape is attached to a release structure on the first side wall and to the ejection head by a first adhesive, and a second removable tape is attached to a portion of the first removable tape by a second adhesive. The second adhesive has an adhesive strength that is about three times greater than an adhesive strength of the first adhesive.

20 Claims, 6 Drawing Sheets

FLUIDIC EJECTION CARTRIDGE FOR IMPROVED PROTECTIVE TAPE REMOVAL

TECHNICAL FIELD

This disclosure relates to the field of fluidic ejection cartridges. More particularly, this disclosure relates to a fluidic ejection cartridge structure for improved protective tape removal therefrom.

BACKGROUND

Fluidic ejection cartridges may be used in variety of applications, including for instance inkjet printing applications, medicinal fluid delivery applications, and vapor delivery applications. The amount of time such cartridges remain in transit from the manufacture and/or in storage (prior to installation and use) may constitute a large portion of the lifecycle of the cartridge. In some instances, the shipping and storage time may even constitute the majority of the lifecycle of the cartridge. Consequently, it is important that the operability of the cartridge not degrade during storage, even if the cartridge remains in storage for an extended period of time.

During shipping and storage of the fluidic ejection cartridges, a protective tape may be used to cover the ejection head and ejection nozzles on the ejection head. The protective tape prevents contamination of the ejection head, prevents seepage of fluid from the ejection head, and reduces the amount of moisture evaporated from the fluid in the cartridge during shipping and storage of the cartridge. Prior to use, the protective tape must be removed from the fluidic ejection cartridge to expose the ejection nozzles. However, removal of the protective tape may itself prove to be problematic and lead to damage of the ejection head or residual tape or adhesive left on the ejection head which can hamper the operation of the fluid ejection device.

In order to prevent damage to the ejection head, a protective tape having a relatively weak adhesive layer is sometimes used. However, if a protective tape is excessively weak in adhesiveness, it is possible that the protective tape will peel and fall off of the ejection head when the fluidic cartridge is clamped to be conveyed or packaged using automatic packaging machines. Excessive vibrations of the fluidic cartridge during packaging and conveying may also cause the protective tape to peel from the ejection head. Accordingly, the use of relatively weak adhesiveness of the protective tape may result in premature peeling of the tape from the ejection head.

In order to assure that the protective tape does not prematurely peel off of the ejection head, a protective tape having greater adhesiveness is typically used in combination with a pull tape. The pull tape assists in removal of the protective tape and may be attached to an underside or to a backside of the protective tape. The pull tape typically contains an adhesive having a substantially greater peel strength than the protective tape. However, if the adhesiveness of the protective tape is great enough to prevent premature peeling from the ejection head, there is a greater possibility that the protective tape will detach from a pull tape used to remove the protective tape and thus remain on the ejection head preventing the ejection head from proper operation.

Accordingly, what is needed is an improved protective tape system for fluidic ejection cartridges that substantially eliminates incomplete removal of the protective tape from an ejection head. It is also desirable to provide a system to ensure that the protective tape is removed from the ejection head prior to usage of the cartridge and that removal of the protective tape does not damage the ejection head.

SUMMARY

With regard to the foregoing, an embodiment of the disclosure provides a fluidic ejection cartridge and protective tape system therefor. The fluidic ejection cartridge includes a cartridge body for fluid having a cover closing a first end thereof, an ejection head on a second end thereof opposite the first end, and side walls attached to the first and second ends between the first and second ends. The side walls include a first side wall, a second side wall opposite the first side wall, a third side wall attached to the first and second side walls, and a fourth side wall opposite the third side wall attached to the first and second side walls. A first removable tape is attached to a release structure on the first side wall and to the ejection head by a first adhesive. A second removable tape is attached to a portion of the first removable tape by a second adhesive. The second adhesive has an adhesive strength that is about three times greater than an adhesive strength of the first adhesive.

In another aspect, the disclosure provides a method for improving the removal of protective tape from an ejection head of a fluidic ejection cartridge. The method includes providing a fluidic ejection cartridge with at least one side wall having a release structure on the at least one side wall. A first removable tape is attached to the release structure on the side wall and to a nozzle plate on the ejection head using a first adhesive having a first peel strength. A second removable tape is attached to a portion of the first removable tape adjacent the release structure on the side wall and to the side wall using a second adhesive. The second adhesive has a second peel strength of about three times greater than the first peel strength of the first adhesive.

In a further aspect, the disclosure provides a fluidic ejection cartridge having an ejection head on a first end wall thereof; first, second, second, third and fourth side walls attached to the first end wall; and a cover opposite the first end wall attached to the first, second, third and fourth side walls, wherein a first side wall contains a protective tape release structure thereon.

In some aspects, the release structure is a scored portion of the first side wall. In other aspects, the scored portion includes a plurality of spaced-apart bull-nose ribs. In some aspects, the ribs have a score depth ranging from about 40 to about 200 microns. In other aspects the ribs have a spacing ranging from about 20 to about 900 microns between adjacent ribs.

In some aspects, the first removable tape has a polyvinyl chloride backer and an acrylic adhesive having a peel strength ranging from about 40 to about 80 Newton per meter (N/m).

In other aspects, the second removable tape is attached to the first side wall adjacent the first removable tape and to the cover of the cartridge body. In other aspects the first removable tape covers a nozzle plate on the ejection head.

An advantage of the embodiments of the disclosure is that the cartridge and tape system is effective to completely remove the protective tape from the ejection head while using a protective tape that has sufficient adhesive strength to prevent premature peeling of the protective tape from the ejection head. The system also enables the use of a pull tape that can effectively remove the protective tape from the ejection head without delaminating from the protective tape.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
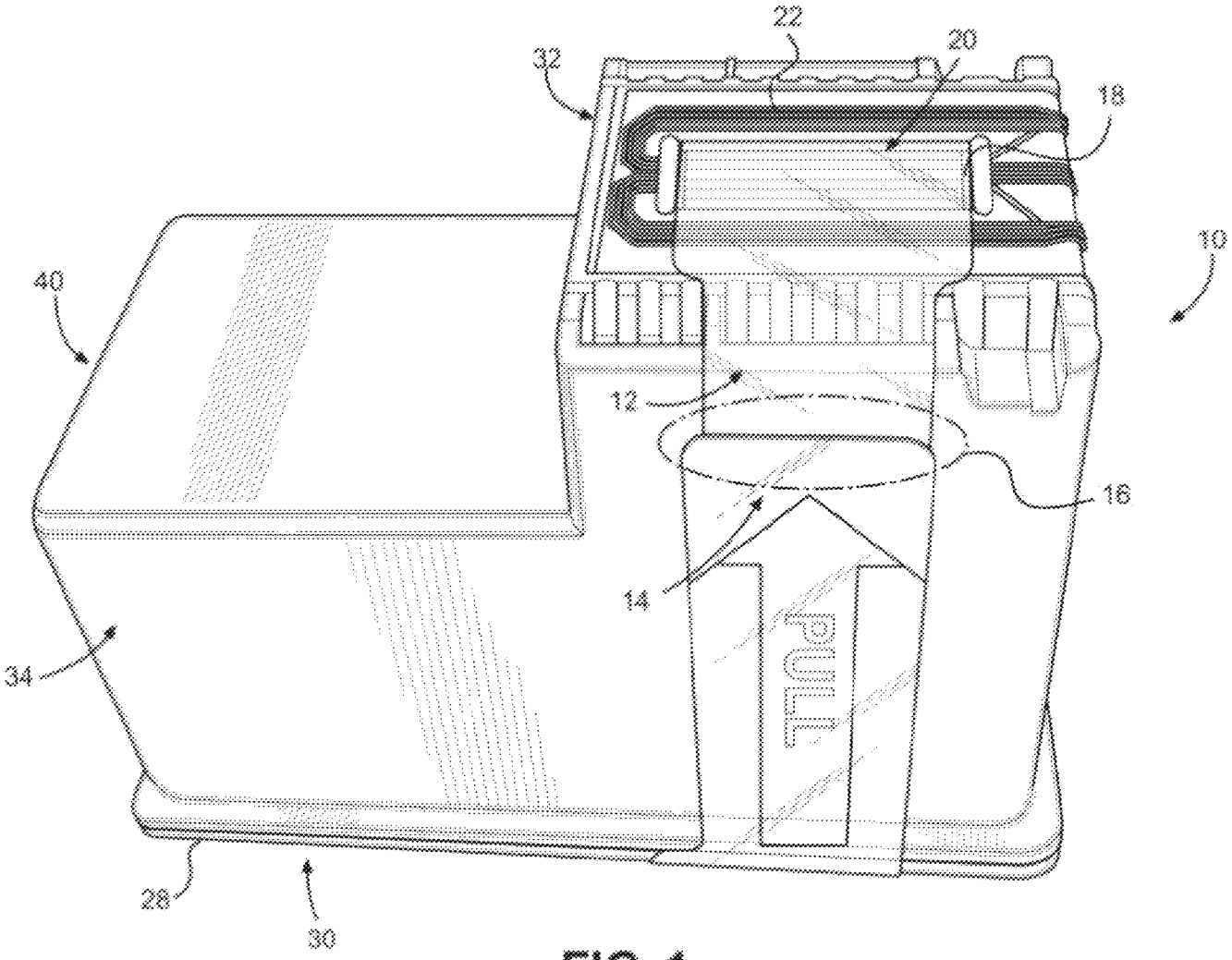
FIG. 1 is a side perspective view of a fluidic ejection cartridge according to an embodiment of the disclosure.
Figure 2:
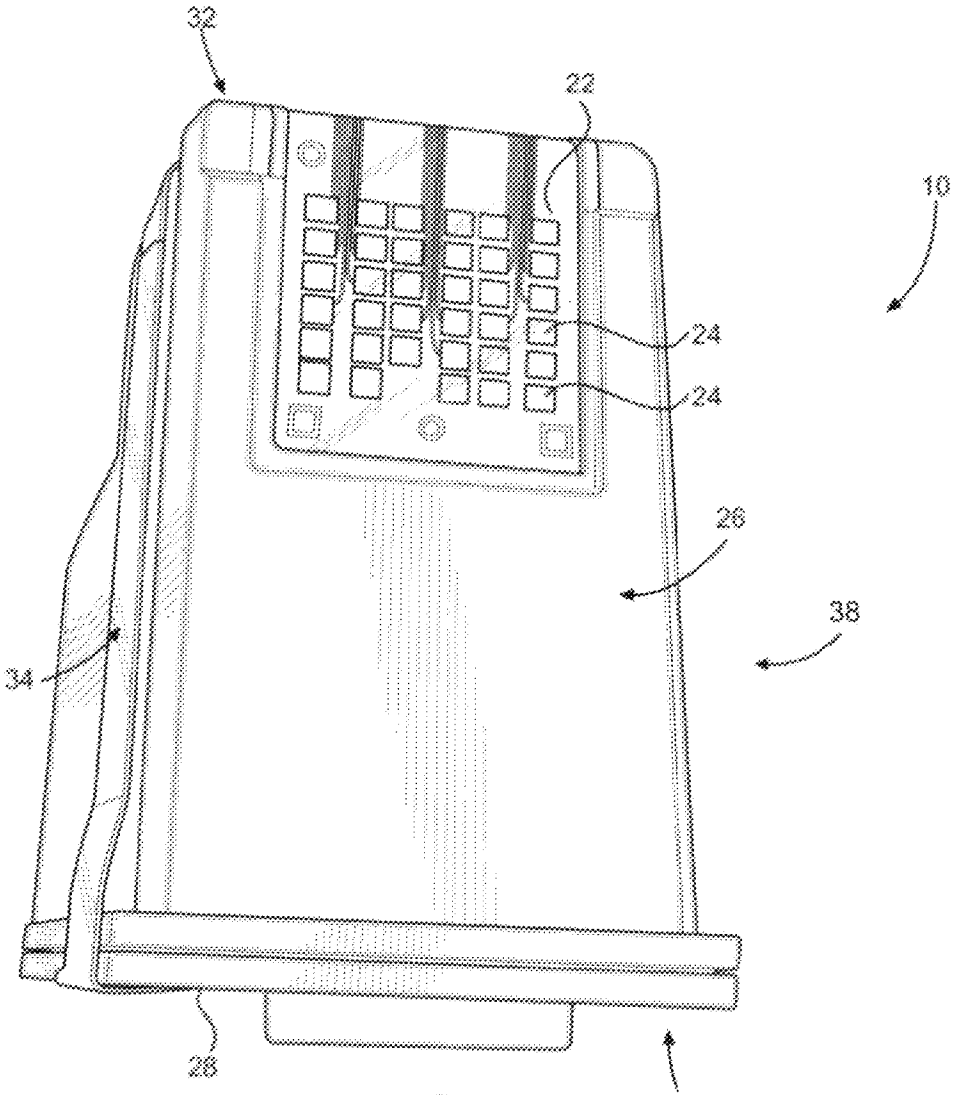
FIG. 2 is an end perspective view of the fluidic ejection cartridge of FIG. 1.
Figure 3:
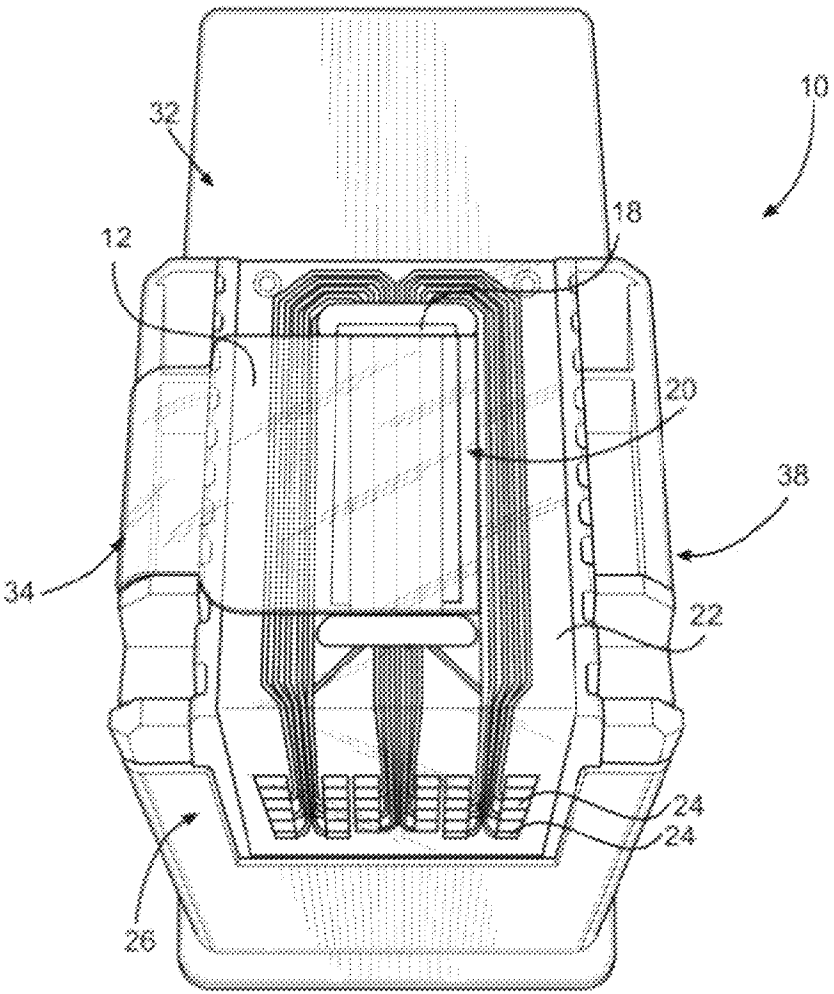
FIG. 3 is a perspective view of an ejection head for the fluidic ejection cartridge of FIG. 1.

The present disclosure provides an improved protective tape system for protecting the ejection head of a fluidic ejection cartridge. A fluidic ejection cartridge 10 is illustrated in FIGS. 1-3 showing a first removable tape 12 and a second removable tape 14 overlapping a portion 16 of the first removable tape 12. The first removable tape 12 is applied to a nozzle plate 18 of an ejection head 20 for the fluidic ejection cartridge 10. A flexible circuit 22 is provided for the ejection head 20 and is folded over to a first end wall 26 of the fluidic ejection cartridge. As shown in FIG. 2, the flexible circuit 22 contains a plurality of contacts 24 for making electrical connection between a fluid ejection device containing the fluidic ejection cartridge 10 and the ejection head 20 for controlling fluid ejection from the ejection head 20.

A cover 28 is provided on a first end 30 of the fluidic ejection cartridge 10, wherein the cover is opposite a second end 32 of the cartridge 10 containing the ejection head 20. The cover is attached to first side wall 34 and second side wall 38. A second end wall 40 opposite the first end wall 26 is attached to the side walls 34 and 38 and the cover 28 providing a closed container for fluid in the fluidic ejection cartridge 10.

Figure 4:
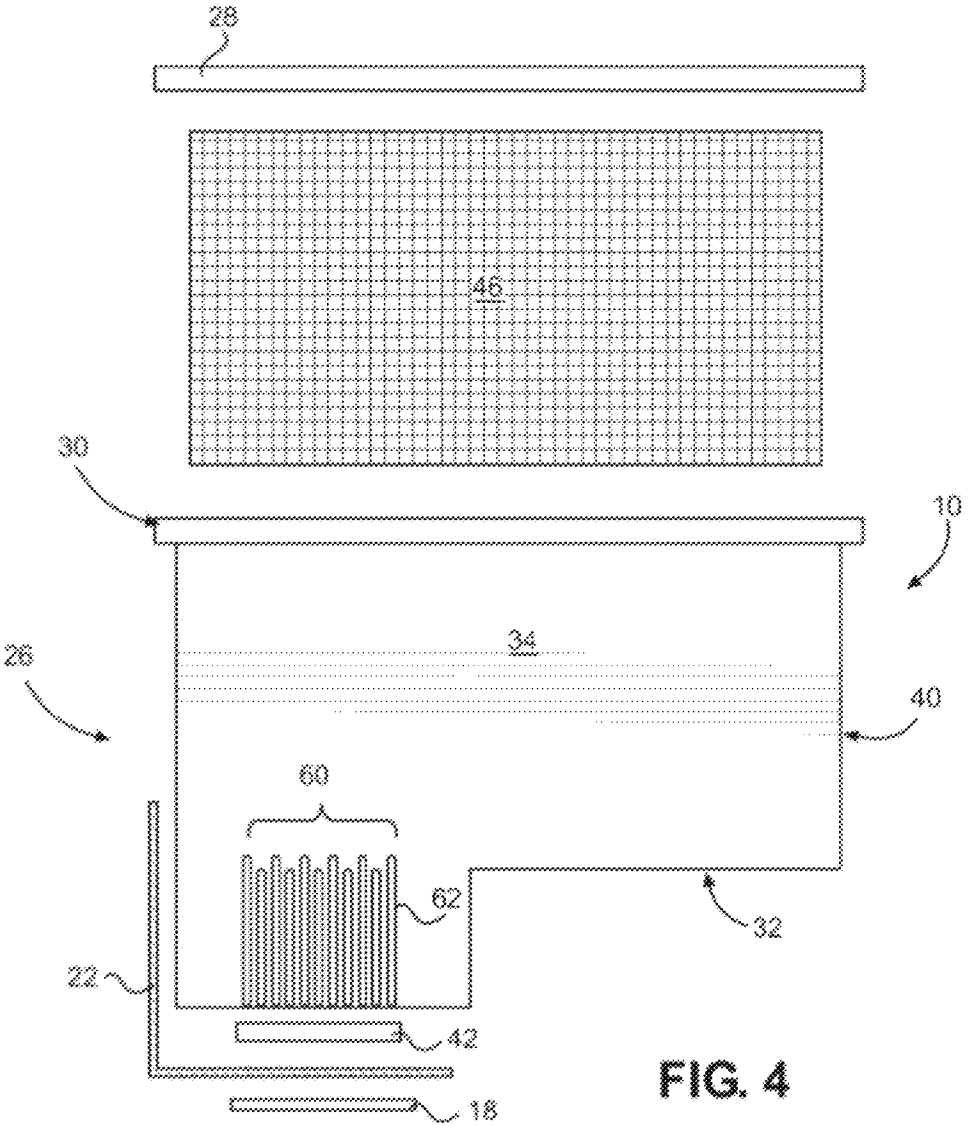
FIG. 4 is a schematic exploded view, not to scale, of the fluidic ejection cartridge of FIG. 1.

Further details of the fluidic ejection cartridge 10 may be seen in an exploded view of the cartridge 10 illustrated schematically in FIG. 4. The ejection head 20 includes a semiconductor substrate 42 to which the flexible circuit 22 is electrically attached and the nozzle plate 18 attached to the semiconductor substrate 42 in a window (not shown) of the flexible circuit 22. In some embodiments, the fluidic ejection cartridge 10 is filled with an open cell foam material 46 that holds fluid to be ejected from the ejection head 20.

Figure 5:
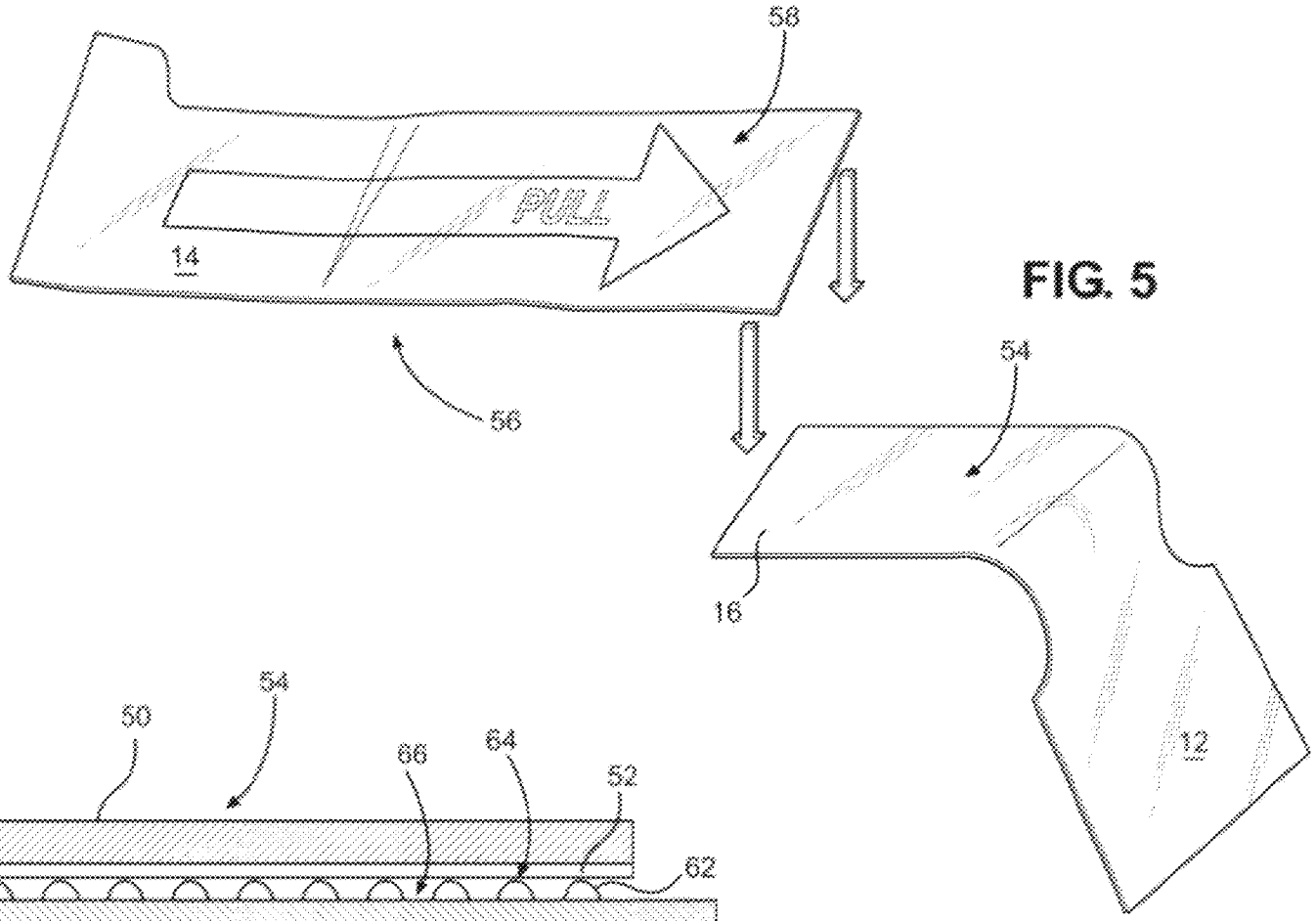
FIG. 5 are perspective view, not to scale, of first and second removable tapes for protecting the ejection head of the fluidic ejection cartridge of FIG. 1.
Figure 6:
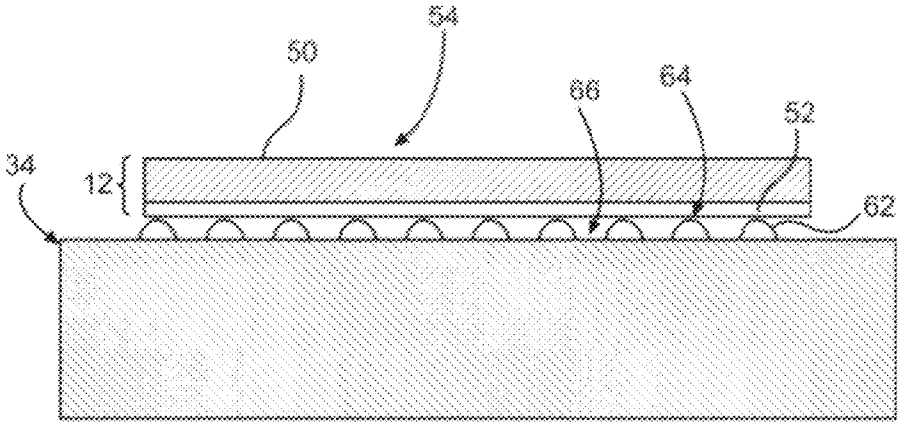
FIG. 6 is a cross-sectional view, not to scale, of the first removable tape of FIG. 5 attached to a release structure on a side wall of the cartridge according to an embodiment of the disclosure.
Figure 7:
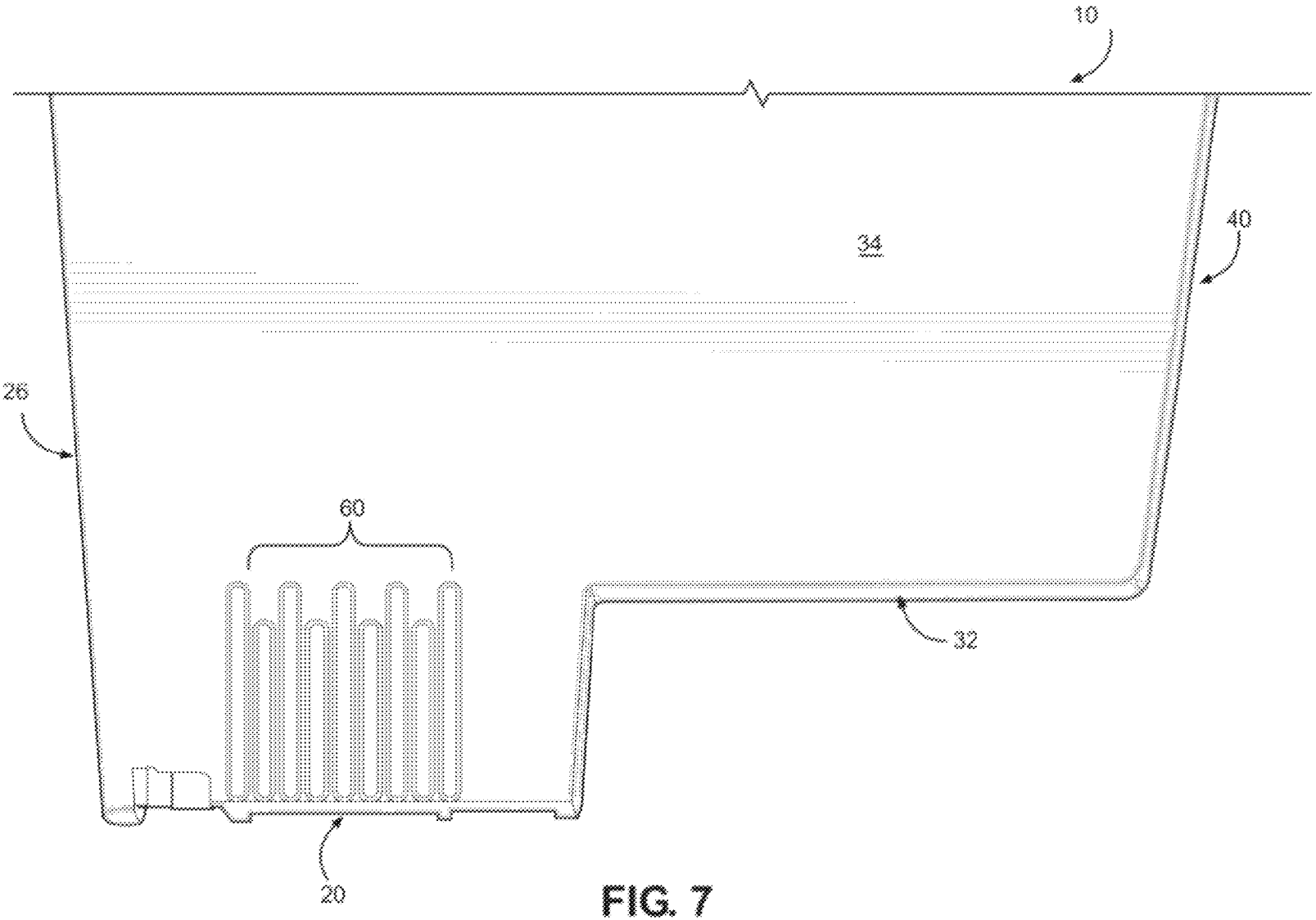
FIG. 7 is a side elevational view of the fluidic ejection cartridge of FIG. 1 with protective tape removed from the fluidic ejection cartridge.

In embodiments described herein, the first removable tape 12 is used to cover and protect nozzle holes on the nozzle plate 18 as described above. The removable tape 12 is shown in FIGS. 5 and 6 and is typically a blue tape 12 having an overall thickness of from about 60 to 80 microns. The first removable tape 12 has a base film layer 50 of polyvinyl chloride having a thickness of from about 50 to about 70 microns and an acrylic adhesive layer 52 on one side thereof having a thickness of from about 5 to about 15 microns. The acrylic adhesive layer 52 has a peel strength ranging from about 40 to about 80 Newton per meter (N/m) on a silicon wafer as determined using a 20-millimeter-wide sample at a peeling speed of 300 mm/min and at an angle of 90 degrees. It is important that removable tape 12 contain a low amount of impurities since it is in intimate contact with the nozzle plate 18 and could contaminate the nozzle holes in the nozzle plate thereby blocking the nozzle holes from functioning properly.

The second removable tape 14 is attached in the overlap area 16 to a backside 54 of the first removable tape 12. The second removable tape can be made of a wide variety of materials provided the adhesive use on an underside 56 of the second removable tape 14 has a peel strength of about 2 times greater and desirably at least about 3 time greater than the peel strength of the first removable tape 12. In some embodiments, the second removable tape 14 has a peel strength of greater than about 120 N/m, such as greater than about 140 N/m, and desirably greater than about 200 N/m. The second removable tape 14 is also attached to the first side wall 34 of the cartridge 10 adjacent to the first removable tape 12.

It will be appreciated that the ejection head 20 with its semiconductor substrate 42 and nozzle plate 18 is a precisely manufactured device that is capable of high resolution fluid ejection. Accordingly, protection of the ejection head 20 is important for the proper operation of the fluid ejection device. As shown in FIG. 1, the first removable tape 12 is applied to the ejection head and the first side wall 34 of the fluidic ejection cartridge 10 and the second removable tape 14 is applied to the first side wall 34 of the fluidic ejection cartridge 10 adjacent an end of the first removable tape 12. Thus, the first removable tape 12 may be peeled from the ejection head 20 in a direction that is orthogonal to a longitudinal direction of the nozzle plate 18 and substrate 42. Such peeling direction is effective to reduce stresses that may occur to the ejection head 20 when the first removable tape 12 is peeled therefrom and reduces the likelihood that the nozzle plate 18 will delaminate from the substrate 42. Accordingly, it is desirable that the first removable tape 12 be peeled in the orthogonal direction rather that in a longitudinal direction with respect to the ejection head.

As shown in FIGS. 1 and 5 it is important that the second removable tape 14 overlap the backside 54 of the first removable tape 12 so that a release structure 60, described below, may be used to improve the removal of the first removable tape 12 from the cartridge 10. Also, since the first removable tape 12 has a lower peel strength than the second removable tape 14, overlapping the first removable tape 12 on a backside 58 of the second removable tape 14, may lead to separation of the first removable tape 12 from the second removable tape 14 and thus incomplete removal of the first removable tape 12 from the ejection head 20.

However, even with the low peel strength of the first removable tape 12, incomplete removal of the first removable tape 12 from the ejection head 20 may occur if there is separation between the first removable tape 12 and the second removable tape 14. Accordingly, the release structure 60 is provided on a portion of the first side wall 34 underlying the first removable tape 12 so that the first removable tape 12 will release from the side wall 34 without separating from the second removable tape 14. In one embodiment, the release structure 60 may be scored portion of the first side wall 34. In another embodiment, the scored portion providing the release structure 60 may be a plurality of spaced-apart bull-nose ribs 62 as shown in FIG. 4. The ribs 62 may have a score depth between adjacent ribs ranging from about 40 to about 200 microns, such as from about 50 to about 190 microns, or from about 60 to about 180 microns in depth, a spacing of the valley between adjacent ribs ranging from about 20 to about 900 microns, such as from about 40 to 700 microns, or from about 80 to about 300 microns, and a rib width ranging from about 100 to about 600 microns, such as from about 200 to about 500 microns, or from about 250 to about 400 microns.

The spaced-apart bull-nose ribs may be molded into the first side wall 34 of the cartridge 10 or may be machined into the side wall 34 after the cartridge is made. Other patterns such as dimples or cross-hatched areas may be used to provide a reduced surface area from adhesive bonding between the acrylic adhesive and the first side wall 34 of the cartridge. Accordingly, the adhesive layer 52 of the first removable tape 12 may be only attached to peaks 64 of the ribs 62 rather than to the side wall 34 in a valley 66 between the ribs 62 (FIG. 6) thereby reducing the area of adhesive bonding between the first removable tape 12 and the side wall 34.

In order to demonstrate the advantages of the embodiments of the disclosure, the following non-limiting example is provided.

EXAMPLE

The first removable tape was applied to a smooth side walls of cartridges and to ribbed side wall of cartridges and the peel strength was measured after 1 day, two weeks and four weeks. The ribs had a depth of 132 microns and a valley spacing between adjacent ribs of 210 microns and a rib width of 390 microns. In each of the examples, the peel speed was 50 mm/min and the peel angle was 90 degrees. The peel strength is shown in the following table.

TABLE

| Sample No. | Surface for removable tape 12 | Peel strength after 1 day (N/m) | Peel strength after 2 weeks (N/m) | Peel strength after 4 weeks (N/m) |
|---|---|---|---|---|
| 1 | Smooth side of cartridge | 30 | 37 | 46 |
| 2 | Smooth side of cartridge | 27 | 35 | 45 |
| 3 | Ribbed area of cartridge | 0.7 | 0.9 | 1.1 |
| 4 | Ribbed area of cartridge | 1.1 | 0.5 | 0.5 |

As shown by the foregoing examples, the peel strength of the first removable tape 12 on a smooth side of the cartridge 10 is about 30 to about 90 times greater than the peel strength of the first removable tape applied to the ribbed area of the cartridge 10. In other words, the ribbed or scored area 60 of the first side wall 34 dramatically reduced the peel strength of the first removable tape 12 so that the first removable tape 12 easily released from the first side wall 34 without separating from the second removable tape 14.

As noted above, fluidic ejection cartridges 10 may be used in variety of applications, including for instance inkjet printing applications. Fluidic ejection cartridges may also be used for other nonprinting applications as well, particularly for applications calling for the precise metering of small amounts of liquid materials and vaporous materials. For example, the ejection cartridges described herein may be used in the preparation of cosmetics, paints, or lubricants and in the ejection of liquids and vapors for medical treatment.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A fluidic ejection cartridge and protective tape system therefor, comprising:

a cartridge body for fluid having a cover closing a first end thereof, an ejection head on a second end thereof opposite the first end, and side walls attached to the first and second ends between the first and second ends, wherein the side walls comprise a first side wall, a second side wall opposite the first side wall, a first end wall attached to the first and second side walls, and a second end wall opposite the first end wall attached to the first and second side walls, a first removable tape attached to a release structure on the first side wall and to the ejection head by a first adhesive, and a second removable tape attached to a portion of the first removable tape by a second adhesive, wherein the second adhesive has an adhesive strength that is greater than an adhesive strength of the first adhesive.

2. The fluidic ejection cartridge of claim 1, wherein the release structure comprises a scored portion of the first side wall.

3. The fluidic ejection cartridge of claim 2, wherein the scored portion comprises a plurality of spaced-apart bull-nose ribs.

4. The fluidic ejection cartridge of claim 3, wherein the plurality of spaced-apart bull-nose ribs have a score depth ranging from about 40 to about 200 microns and a spacing ranging from about 20 to about 900 microns between adjacent ribs.

5. The fluidic ejection cartridge of claim 1, wherein the first removable tape comprises a polyvinyl chloride backer and an acrylic adhesive having a peel strength on a silicon wafer ranging from about 40 to about 80 Newton per meter (N/m).

6. The fluidic ejection cartridge of claim 1, wherein the second removable tape is attached to the first side wall adjacent to the first removable tape.

7. The fluidic ejection cartridge of claim 1, wherein the first removable tape covers a nozzle plate on the ejection head.

8. A fluidic ejection device comprising the fluidic ejection cartridge of claim 1.

9. A method for improving the removal of protective tape from an ejection head of a fluidic ejection cartridge, comprising providing a fluidic ejection cartridge with at least one side wall having a release structure on the at least one side wall, attaching a first removable tape to the release structure on the side wall and to a nozzle plate on the ejection head using a first adhesive having a first peel strength, attaching a second removable tape to a portion of the first removable tape adjacent the release structure on the side wall and to the side wall using a second adhesive, wherein the second adhesive has a second peel strength that is greater than the first peel strength of the first adhesive.

10. The method of claim 9, wherein the release structure comprises a scored portion of the side wall.

11. The method of claim 10, wherein the scored portion comprises a plurality of spaced-apart bull-nose ribs.

12. The method of claim 11, wherein the plurality of spaced-apart bull-nose ribs have a score depth ranging from about 40 to about 200 microns and a spacing ranging from about 20 to about 900 microns between adjacent ribs.

13. The method of claim 9, wherein the first removable tape comprises a polyvinyl chloride backer and an acrylic adhesive having a peel strength on a silicon wafer ranging from about 40 to about 80 Newton per meter (N/m).

14. A fluidic ejection cartridge comprising;

an ejection head on a first end wall thereof;

first, second, second, third and fourth side walls attached to the first end wall; and a cover opposite the first end wall attached to the first, second, third and fourth side walls, wherein a first side wall contains a protective tape release structure thereon.

15. The fluidic ejection cartridge of claim 14, wherein the first side wall is orthogonal to a longitudinal direction of the ejection head.

16. The fluidic ejection cartridge of claim 14, wherein the release structure comprises a scored portion of the first side wall.

17. The fluidic ejection cartridge of claim 16, wherein the scored portion comprises a plurality of spaced-apart bull-nose ribs.

18. The fluidic ejection cartridge of claim 17, wherein the plurality of spaced-apart bull-nose ribs have a score depth ranging from about 40 to about 200 microns.

19. The fluidic ejection cartridge of claim 17, wherein the plurality of spaced-apart bull-nose ribs have a spacing ranging from about 20 to about 900 microns between adjacent ribs.

20. The fluidic ejection cartridge of claim 14, wherein the release structure is molded into the first side wall of the fluidic cartridge.

* * * * *